United States Patent [19]

Brunner

[11] Patent Number: 4,903,367

[45] Date of Patent: Feb. 27, 1990

[54] APPARATUS FOR PNEUMATIC DEDUSTING FOR TEXTILE MACHINES

[75] Inventor: Heinz Brunner, Albstadt-Ebingen, Fed. Rep. of Germany

[73] Assignee: Sipra Patententwicklungs-und Beteiligungsgesellschaft mbH, Albstadt, Fed. Rep. of Germany

[21] Appl. No.: 233,277

[22] Filed: Aug. 17, 1988

[30] Foreign Application Priority Data

Aug. 29, 1987 [DE] Fed. Rep. of Germany ..... 3728985

[51] Int. Cl.[4] ..... B08B 5/02

[52] U.S. Cl. ..... 15/301; 15/316 R; 242/131.1

[58] Field of Search ..... 15/301, 316 R; 242/131.1

[56] References Cited

U.S. PATENT DOCUMENTS

| | | | |
|---|---|---|---|
| 2,147,190 | 2/1939 | Cadden | 15/301 |
| 2,976,668 | 3/1961 | Reiterer | 15/301 X |
| 3,311,135 | 3/1967 | Maguire et al. | 15/301 X |
| 3,410,070 | 11/1968 | Denis | 15/301 X |
| 3,667,093 | 6/1972 | Culpepper | 242/131.1 X |
| 4,333,201 | 6/1982 | Rohner | 15/301 |
| 4,784,349 | 11/1988 | Renwick et al. | 15/301 X |

FOREIGN PATENT DOCUMENTS

| | | | |
|---|---|---|---|
| 1064694 | 4/1967 | United Kingdom | 15/301 |

*Primary Examiner*—Chris K. Moore
*Attorney, Agent, or Firm*—Michael J. Striker

[57] ABSTRACT

An apparatus for pneumatic dedusting of yarn supply supports and thread guiding elements of textile machines comprises at least one blowing element which forms a blowing air stream in a dust forming region occupied by a yarn supply support and a thread guiding element, and at least one filter lattice wall which bounds the dust forming region on its periphery at least locally, so that the blowing air stream which exits the dust forming region is directed to the filter lattice wall.

14 Claims, 3 Drawing Sheets

Fig. 3
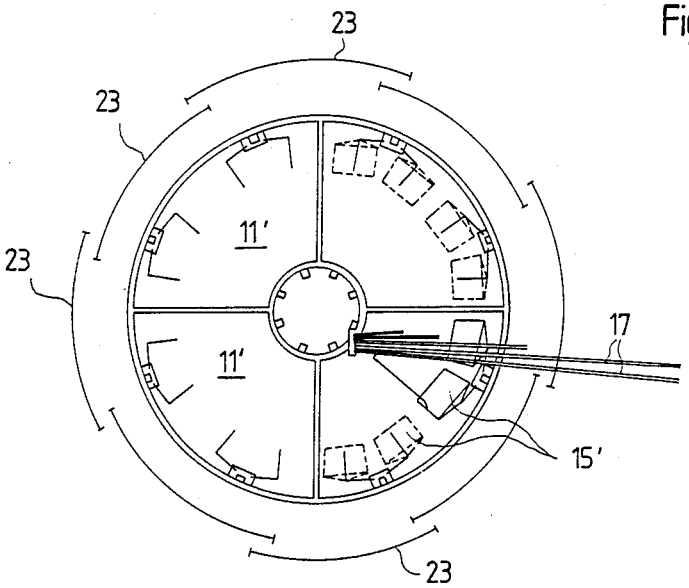
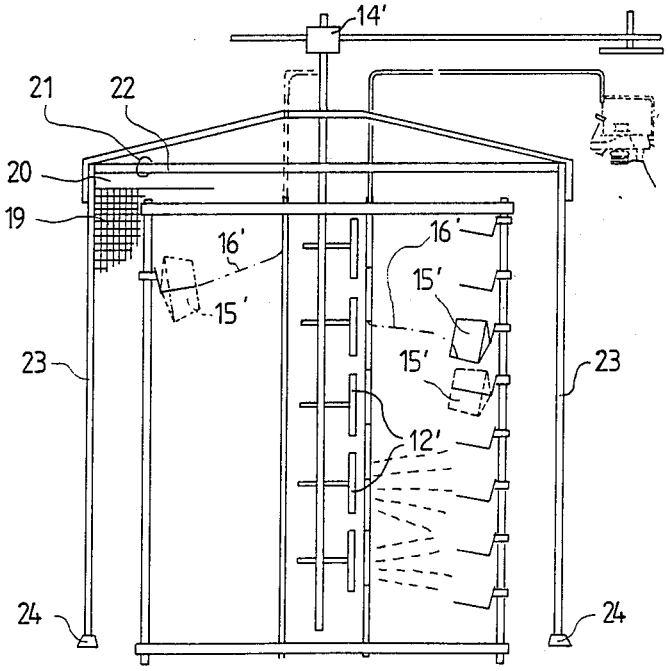
Fig. 2

APPARATUS FOR PNEUMATIC DEDUSTING FOR TEXTILE MACHINES

BACKGROUND OF THE INVENTION

The present invention relates to an apparatus for pneumatic dedusting of yarn supply supports and thread conducting elements of textile machines. More particularly, it relates to an apparatus which has at least one ventilator or a blowing nozzle which produces a blowing air stream in a dust forming region which yarn supply supports and thread guiding elements.

During working of yarns and threads the generation of flying fibers is unavoidable, when yarns or threads are withdrawn from yarn supply supports or guided through thread guiding elements. During thread discharge loose fibers are released or during thread guidance detached threads are released. For protecting the textile machines and their associated devices from collecting dirt and for protecting the operating personnel from the flying fibers, many forms of a dedusting apparatus are proposed. The best solution is provided by an apparatus in which the fibers are first blown away from the machine parts and then aspirated into a filtering device. Such an apparatus has however the disadvantage that it is very expensive and the region to be dedusted must be limited by fixed walls. This expense is justified in the immediate region of the yarn processing locations for example on knitting machines, but to a lesser extent on the proposed auxiliary devices such as yarn supply supports which become considerably more expensive because of such a dedusting arrangement.

SUMMARY OF THE INVENTION

Accordingly, it is an object of the present invention to provide an apparatus for pneumatic dedusting of textile machines, which avoids the disadvantages of the prior art.

More particularly, it is an object of the present invention to provide an apparatus for dedusting of textile machines which is economical and despite this provides satisfactory dedusting of auxiliary devices and bounded protection of neighboring devices from dusting.

In keeping with these objects and with others which will become apparent hereinafter, one feature of the present invention resides, briefly stated, in an apparatus in which a dust forming region is limited at least locally by at least one filter lattice wall, against which a blowing air stream exiting the dust forming region is directed. Advantageously, the filter lattice wall can be arranged transversely to the blowing air stream.

When the apparatus is designed in accordance with the present invention, the yarn supply support and subsequent thread guiding elements are cleansed by blowing for example by means of blowing nozzles or blowers. The blown away fibers are held on simple filter lattice wall which do not have an expensive construction, can be easily adjusted to different structural environments, and then fibers can be aspirated with a dust sucker in a simple manner or brushed away in a special dust collecting chamber. The special advantage of the arrangement is that the dust forming region must not be bounded by fixed wall which make difficult the operation of the yarn supply supports and thread guiding elements to be dedusted. In the apparatus in accordance with the present invention, the filter lattice wall can be composed of several curtain-like displaceable and overlapping filter lattice webs, which are arranged in a suspended fashion and when needed displaced easily.

With the economical dedusting arrangement in accordance with the present invention, also only predetermined regions can be protected from flying fibers, or substantially individual knitting machines from yarn stands which are arranged nearby. Such yarn stands are frequently blown by blowers which are mounted on movable supports. Here the filter lattice wall in accordance with the present invention can protect only the portions of the periphery of such spool grids in which personnel operates or in which a textile machine is located.

The filter lattice can advantageously be composed of an electrically chargeable synthetic plastic material which attracts the flying fibers. The filter lattice can also be composed of a metal wire and held under a voltage potential which is favorable for folding the deposited fibers. Experiments have shown that the filter lattice even without charging and also without roughened outer surfaces holds the blown flying fibers satisfactorily, and the flying fibers can be easily aspirated subsequently.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a side view of a round spool rack with a pneumatic dedusting apparatus in accordance with a second embodiment of the present invention;

FIG. 3 is a schematic plan view of the spool rack of FIG. 2;

DESCRIPTION OF THE PREFERRED EMBODIMENTS

Figure 1:
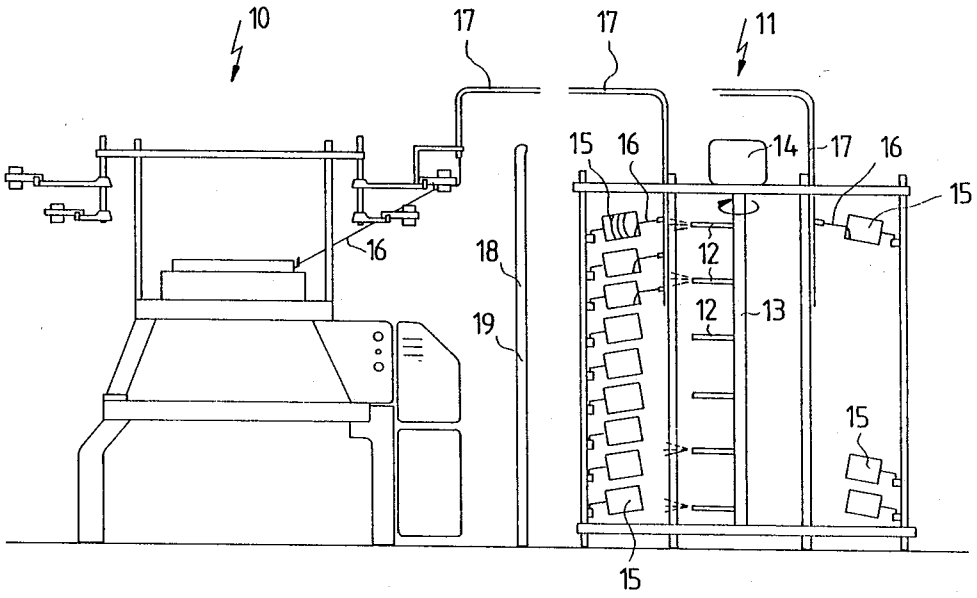
FIG. 1 is a view schematically showing a circular knitting machine with a spool rack located nearby and a first embodiment of a pneumatic dedusting apparatus in accordance with the present invention.

FIG. 1 schematically shows a circular knitting machine 10 and a coil rack 11 which is located near it in a known circular structure. A pipe 13 provided with a plurality of blowing nozzles 12 is located in the center of the spool rack 11. The pipe 13 extends vertically and is rotated by an electric motor 14. Pressurized air is supplied through the pipe.

Reference numeral 15 identifies nozzles from which thread 16 is pulled through a thread guiding pipe 17 to the circular knitting machine 10. By means of the blowing nozzles 12 the spools 15 which are arranged in the spool rack 11 are freed of dust and loose fibers which are blown radially outwardly from the spool rack 11. For protecting the circular knitting machine 10 from these flying fibers, a screening wall 18 of a filter lattice 19 is arranged in the shown embodiment between the circular knitting machine and the spool rack 11. It is formed as a flat screen wall in which the filter lattice is mounted in a supporting frame which in turn rests on standing legs. The filter lattice wall 18 can also be curved in accordance with the curvature of the periphery of coil rack 11 or the circular knitting machine 10 and suspended on an upper not shown supporting frame.

Figure 4:
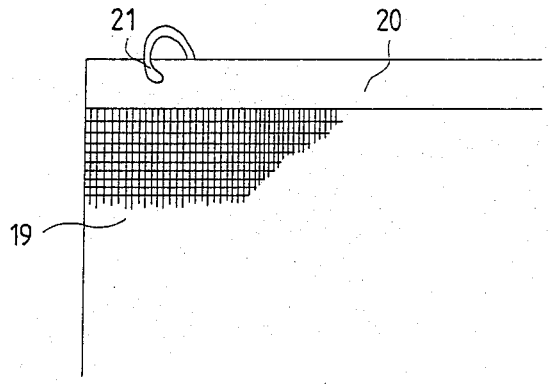
FIG. 4 is a view partially showing a filter lattice wall of the dedusting apparatus in accordance with the present invention.

FIG. 4 shows a corner region of a flexible filter lattice which is woven of synthetic plastic wires or metal wires. It is provided with an upper supporting strip 20. Rings 21 for suspending the filter lattice wall can be anchored in the upper supporting strip 20.

FIGS. 2 and 3 show a side view and a plan view of a round coil rack 11' which is provided in its center with rotating blowers 12' for cleaning yarn spools 15'. Means 14' for rotating the blowers 12' similar to the electric motor 14 in FIG. 1 are also provided. The coil rack 11' is provided with upper ring-shaped supporting rails 22, one of which is shown in FIG. 2. Filter lattice webs 23' are suspended as curtains in a displaceable and overlapping manner on the supporting rail 22, in two concentric ring planes on the outer side of the coil rack 11' over the whole periphery of the latter. The filter lattice webs 23 are loaded at their lower side with a weight strip 24 or fixed on the rails. The fibers which are blown radially outwardly by the rotatable blowing nozzles 12' in the round rack 11' provided in a dust forming region from the coil 15' and from the fibers 16' which are pulled from them, remain hanging on the filter lattice webs 23 through which the blowing air passes outwardly. The filter lattice web 23 can be cleaned after the end of the operation or during layer exchange, easily by means of a vacuum cleaner.

Figure 5:
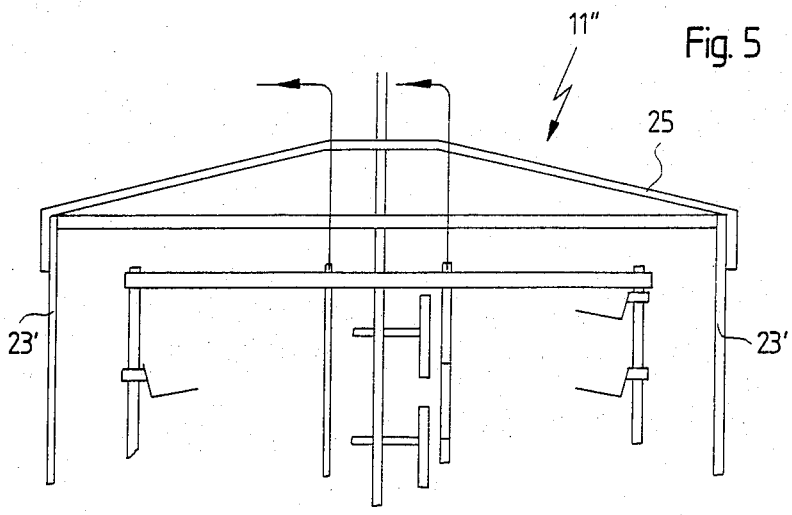
FIG. 5 is a view schematically showing a spool round rack with a fitted filter lattice hood.

As can be seen from FIG. 5, a coil rack 11'' can be also be provided on its upper part with a light filter lattice hood 25. The filter lattice can be spanned over a not shown light pipe frame. The filter lattice hood 25 can be composed of several parts for facilitating its dismantling required for cleaning. For example, it can be assembled of two halves. The filter lattice hood can be constructed so that the filter lattice webs 23' which laterally screen the coil rack 11'' are suspended on its support frame.

The filter lattice walls of the dedusting apparatus in accordance with the present invention can be adapted to the size and shape of all possible dimensions of dust forming regions which must be completely or partially screened. In the event of rectilinear coil racks, rectilinear filter lattice walls are used. The filter lattice walls can be provided with an electric charge by means of a not shown electrical device or by a synthetic plastic material which is loaded by simple rubbing. This is favorable for adherence of flowing fibers which are blown thereon.

It will be understood that each of the elements described above, or two or more together, may also find a useful application in other types of constructions differing from the types described above.

While the invention has been illustrated and described as embodied in an apparatus for pneumatic dedusting of textile machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for pneumatic dedusting of yarn supply supports and thread guiding elements of textile machines, comprising filter lattice wall which substantially completely surrounds a dust forming region occupied by said yarn supply supports and said thread guiding elements on its periphery, and at least one blowing element which forms an air stream in said dust forming region, said blowing element being oriented and positioned with respect to said filter lattice wall so that said air stream from said blowing element exits from said dust forming region and is directed toward said filter lattice wall.

2. A dedusting arrangement as defined in claim 1, wherein said blowing element which produces said blowing air stream is a blower.

3. A dedusting arrangement as defined in claim 1, wherein said blowing element which produces said blowing air stream is a blowing nozzle.

4. A dedusting arrangement as defined in claim 1, wherein said filter lattice wall extends transversely to said blowing air stream.

5. A dedusting arrangement as defined in claim 1, wherein said filter lattice wall includes a supporting frame and a flexible filter lattice which is mounted on said supporting frame so as to surround said dust forming region.

6. A dedusting arrangement as defined in claim 5, wherein said supporting frame of said filter lattice wall is a one-part supporting frame.

7. A dedusting arrangement as defined in claim 5, wherein said supporting frame of said filter lattice wall is a multi-part supporting frame.

8. A dedusting arrangement as defined in claim 1, wherein said filter lattice wall is composed of a plurality of curtain-like filter lattice webs which are arranged in a displaceable and overlapping fashion.

9. A dedusting arrangement as defined in claim 8, wherein each of said filter lattice webs has a lower edge and is provided at said lower edge with a weight member.

10. A dedusting arrangement as defined in claim 1; and further comprising a movable support which is arranged to support said blowing element for producing a blowing air stream.

11. A dedusting arrangement as defined in claim 10, wherein said blowing element for producing a blowing air stream produces a blowing air stream which acts intermittently on said filter lattice wall.

12. A dedusting arrangement as defined in claim 11, wherein said filter lattice wall is stationary.

13. A dedusting arrangement as defined in claim 1, wherein said filter lattice wall is composed of an electrically chargeable synthetic plastic material.

14. A dedusting arrangement as defined in claim 1, wherein said filter lattice wall is made of metal wire.

* * * * *